US007375674B2

(12) United States Patent
Hanahara et al.

(10) Patent No.: US 7,375,674 B2
(45) Date of Patent: May 20, 2008

(54) SWITCHING DEVICE AND REMOTE CONTROL USING THE SWITCHING DEVICE

(75) Inventors: Tetsuro Hanahara, Fukui (JP); Shigeru Shibutani, Fukui (JP); Takaya Nakamura, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 211 days.

(21) Appl. No.: 11/274,319

(22) Filed: Nov. 16, 2005

(65) Prior Publication Data

US 2006/0132347 A1 Jun. 22, 2006

(30) Foreign Application Priority Data

Dec. 10, 2004 (JP) ..... 2004-357847

(51) Int. Cl.
*G08C 19/12* (2006.01)

(52) U.S. Cl. ..... 341/176; 341/22; 200/11 R; 200/11 A

(58) Field of Classification Search ..... 341/176, 341/22; 200/11 R, 11 A, 14
See application file for complete search history.

(56) References Cited

U.S. PATENT DOCUMENTS 4,394,546 A * 7/1983 Harumatsu ..... 200/5 R
5,619,021 A * 4/1997 Yamamoto et al. ..... 200/6 A
6,005,554 A * 12/1999 Kim ..... 345/167

FOREIGN PATENT DOCUMENTS

| | | | |
|---|---|---|---|
| CN | 2508377 Y | | 8/2002 |
| JP | 4-118542 | | 10/1992 |
| JP | 2003-132765 | | 5/2003 |
| JP | 2005-032450 | * | 7/2003 |

* cited by examiner

*Primary Examiner*—Timothy Edwards, Jr.
(74) *Attorney, Agent, or Firm*—McDermott Will & Emery LLP

(57) ABSTRACT

The invention relates to a switching device and a remote control unit using the switching device to be used for operating a variety of electronic products. The invention aims to provide a device and unit which can be miniaturized and which can utilize a high-density components mounting technology. A switch (12) is disposed inside an inner periphery of the rotary operating part (17), and a lever (14) of the switch (12) is engaged with a cam (18) formed at an inner boundary of the operating part (17), constituting a switching device (19). With this constitution, the switching device and the remote control unit using the device can be provided miniaturized using a high-density components mounting.

3 Claims, 3 Drawing Sheets

SWITCHING DEVICE AND REMOTE CONTROL USING THE SWITCHING DEVICE

TECHNICAL FIELD

This invention relates to a switching device to be used for various electronic products and a remote control unit using the switching device.

BACKGROUND ART

In recent years, an audio and a video product, an air-conditioner and other various electronic products are gaining higher functions. In this trend, a switching device and a remote control unit which can be used for diversified operations and are produced in a compact size are demanded.

A conventional switching device is explained using FIG. 4.

FIG. 4 is a perspective view of the conventional switching device. A plurality of wiring patterns is formed (not shown) on at least one of a main side and an other main side of wiring substrate 1 as shown in the drawing. Operating part 2 is placed on one of the main side and the other side of wiring substrate 1 in a rotatable manner. The operating part is substantially in a disk shape. A plurality of cams 3, 3A and 3B are formed at a lower outer periphery of operating part 2. The cams extrude outward and are formed with a certain distance between each cam.

Switch 4 includes lever 5 which extrudes from case 6 made of insulating resin. Lever 5 can be rock-motioned. When lever 5 is rock-motioned in right or left direction that is in R4 or L4 direction, a moving contact piece (not shown) accommodated in case 6 is connected to or disconnected from a plurality of fixed contact pieces (not shown) in switch 4. An electric signal switched by switch 4 is output from a plurality of terminals 7

Switch 4 is so called a 'return-to-neutral' type. When an operational force applied to lever 4 is removed after rocking the lever in right or left direction namely in R1 or L1 direction, the lever automatically returns to an original neutral position with a resilient force of a spring (not shown) accommodated in case 6.

Switch 4 is placed at an outside part of the outer periphery of operating part 2 mounted on one of the main sides so as lever 5 to be engaged with cams 3, 3A or 3B of operating part 2. Terminals 7 are soldered to predetermined spots of the wiring pattern and are connected to a controller (not shown) that is composed of a microprocessor and other electronic components, constituting the switching device.

The conventional switching device constituted in this manner is installed in an electronic product or in a remote control unit with operating part 2 protruding from an operational part of the electronic product or the control unit, and the wiring pattern of wiring substrate 1 is electrically connected to an electronic circuit of the product or the remote control unit through a connector or the like.

In above constitution, when operating part 2 is rotated in clockwise or counter-clockwise direction, cam 3A or cam 3B of operating part 17 comes into contact with lever 5 of switch 4 with rotational movement of the operating part, rocking lever 5 in left or right or in L4 or R4 direction, making an electrical connection or disconnection of the moving contact piece with the fixed contact piece.

As an example, when operating part 2 is largely rotated in counter-clockwise direction, cam 3B first pushes lever 5 of switch 4 rocking the lever in R4 direction. The lever once automatically returns to the original neutral position, and then pushed by cam 3C and rocked again in R4 direction, making two times of electrical connection and disconnection.

The electric signals caused by the electrical connections and disconnections are output through a plurality of terminals 7 to the controller. As lever 5 is rocked in R4 or L4 direction by certain times, the controller detects the rotational direction and an angle of operating part 2 corresponding to times of electrical connection and disconnection, recognizing a moved position of operating part 2.

Thus, with the rotational movement of operating part 2, audio volume, channel selection of TV, temperature of air-conditioner and other switching activities can be controlled.

As prior technical information on the applied invention, Japanese Patent Unexamined Publication No. 2003-132765 is available.

In the conventional switching device, however, switch 4 is disposed at an outside part of an outer periphery of operating part 2, and lever 5 is pushed by the moving force of cams 3, 3A, 3B and 3C extruding from operating part 2, so a large space is taken on wiring substrate 1, making a high-density components mounting difficult.

SUMMARY OF INVENTION

The present invention aims to solve above-mentioned problem in the conventional device, providing a switching device and a remote control unit in a compact size and realizing a high-density components mounting.

In order to achieve the above objective, the device and the unit of the invention has a following constitution.

The switching device according to the present invention includes a switch disposed inside an inner periphery of a rotatable and movable operating part. A lever of the switch is engaged with a cam formed on an inner boundary of the operating part, constituting the switching device. With this constitution, a total size is of the switching device is reduced, easily achieving miniaturization of the switching device.

The remote control unit according to the present invention includes the switching device, a pressing part on which a plurality of keys is formed and a moving contact in the key making an electrical connection with and disconnection from a fixed contact, and a controller electrically connected to the switch and the pressing part, thus constituting the remote control unit. By using the switching device which can be easily reduced in size, miniaturization of the remote control unit and a high-density components mounting are realized.

An other remote control unit according to the present invention includes a wall part protruding from the pressing part. The wall part retains the switch and prevents the switch from being tilted or displaced, thus enabling a stable operation of the remote control unit.

As described, according to the present invention, a switching device that can be miniaturized and that can be produced with high-density components mounting, and a remote control unit using the switching device are obtained in a very efficient manner.

REFERENCE MARKS IN THE DRAWING

Figure 1:
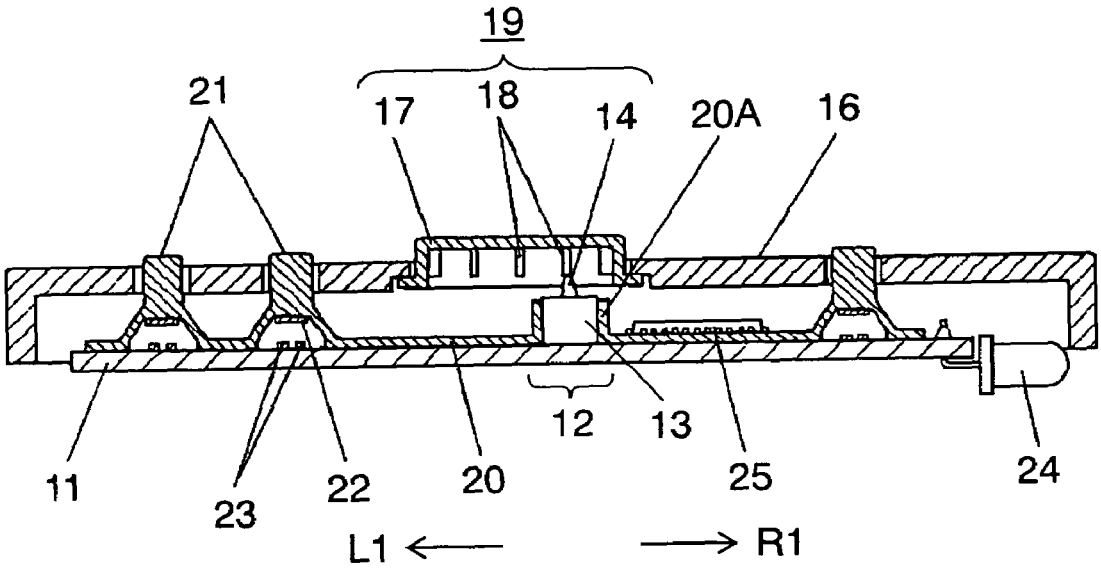
FIG. 1 is a cross-sectional explanatory view of a remote control unit in accordance with an exemplary embodiment of the present invention.

11 wiring substrate
12 switch
13 case
14 lever
15 terminal
16 package
17 operating part
18, 18A, 18C, 18C cam
19 switching device
20 pressing part
20A wall part
21 key
22 moving contact
23 fixed contact
24 transmitter
25 controller

DETAILED DESCRIPTION OF THE PREFERRED EMBODIMENT

Figure 2:
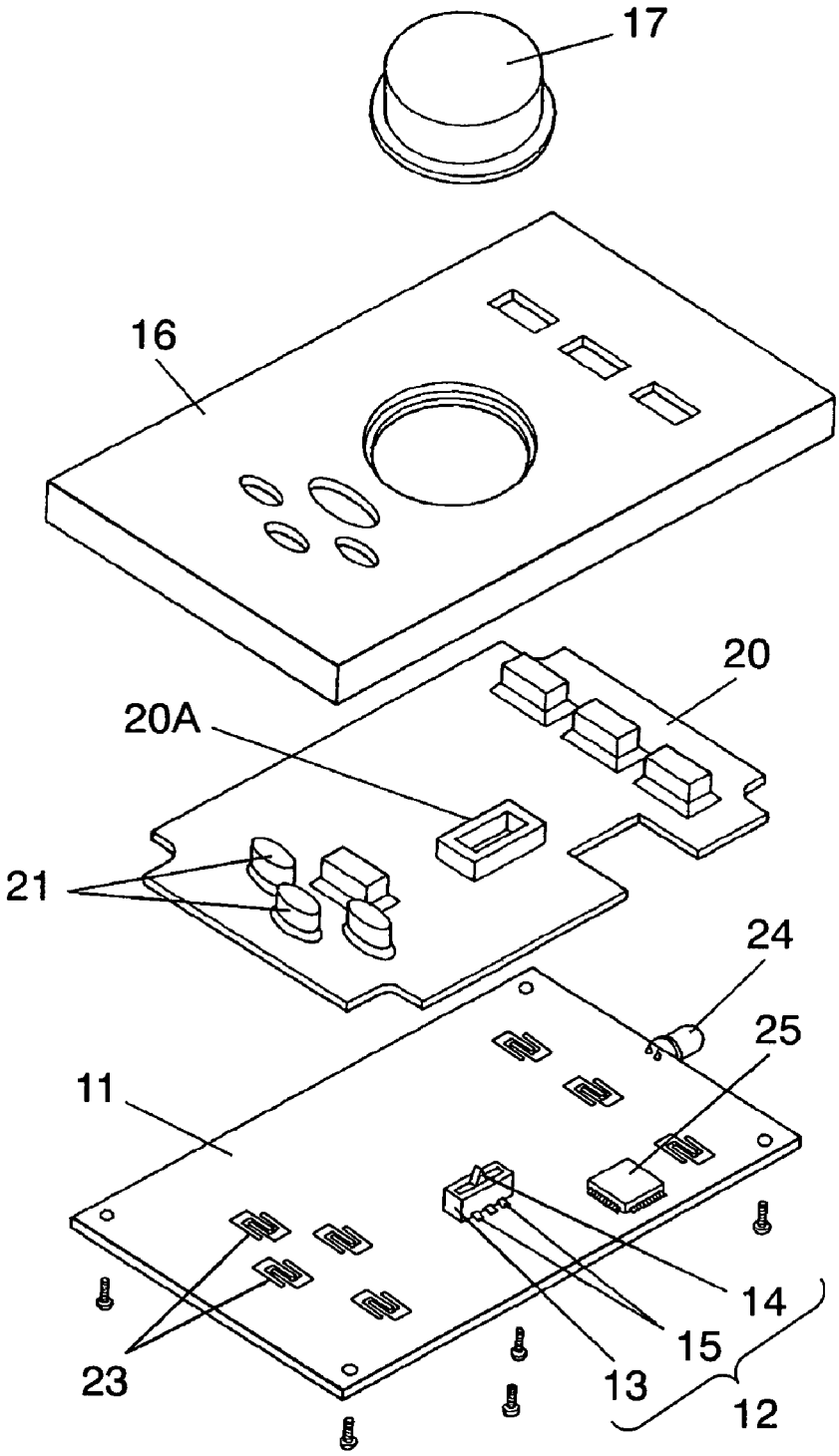
FIG. 2 is an exploded perspective view of the remote control unit.
Figure 3:
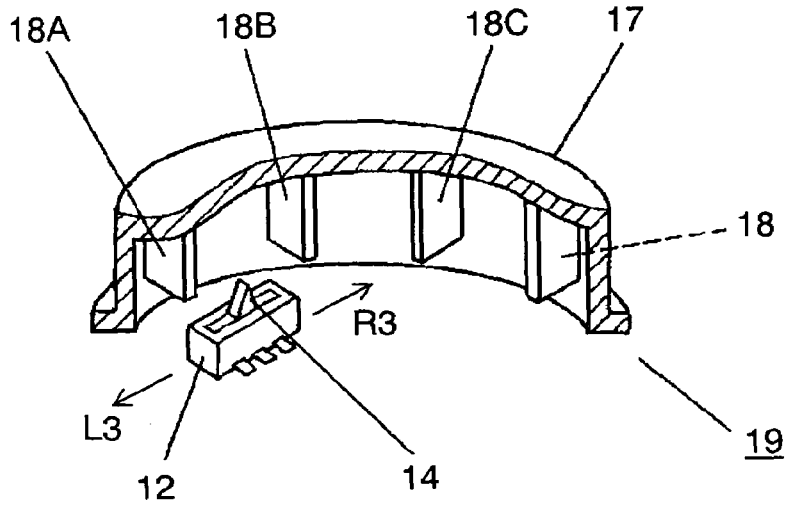
FIG. 3 is a partial cross-sectional perspective view of a switching device in accordance the exemplary embodiment of the present invention.
Figure 4:
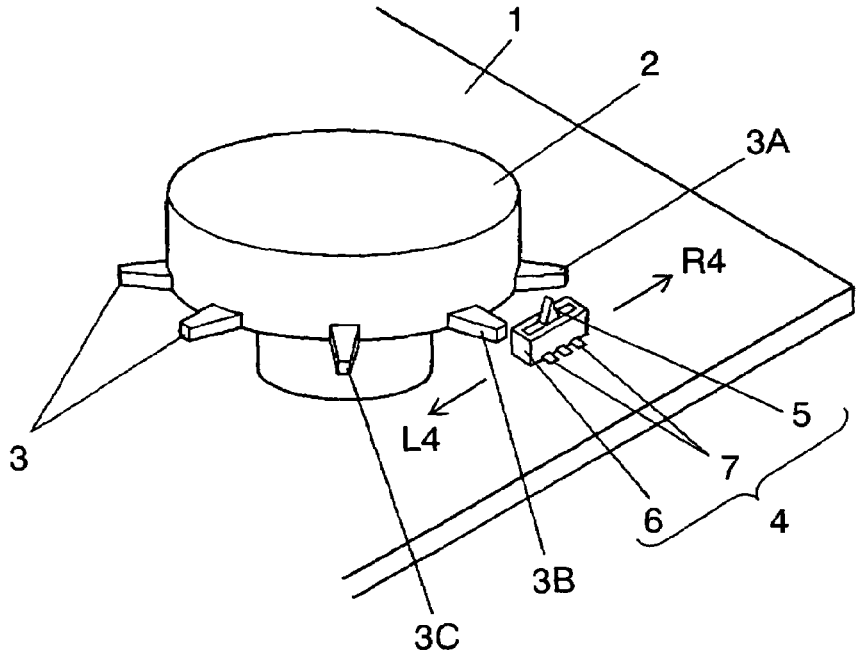
FIG. 4 is a perspective explanatory view of a conventional switching device.

Following, an exemplary embodiment of this invention is explained using FIGS. 1 to 3.

Exemplary Embodiment

FIG. 1 is a cross-sectional explanatory view of a remote control unit in accordance with an exemplary embodiment of the present invention, and FIG. 2 is an exploded perspective view of the same. In FIGS. 1 and 2, a plurality of wiring patterns of a copper foil or the like (not shown) is formed on at least one of a main side and an other main side of substrate 11 which is made of paper phenol, glass epoxy or the like. Switch is mounted on one of the main sides.

Switch 12 includes lever 14 which is extruded from case 13 of insulating resin. The lever can be rocked in right and left directions namely in R1 and L1 directions. With this rocking operation, a moving piece (not shown) which is accommodated in case 13 is electrically connected with and disconnected from a plurality of terminals (not shown). An electric signal caused by the connection and disconnection is output through a plurality of terminals.

Switch 12 is so called a return-to-neutral type. When a rocking force that is applied to lever 14 rocking the lever in right or left direction namely in R1 or L1 direction is released, the lever returns automatically to an original neutral position by a resilient forced of a spring (not shown) which is accommodated in case 13.

Package 16 is made of insulating resin material such as polystyrene and ABS, and the package is formed in substantially a box shape. Operating part 17 is also made of insulating resin material. The operating part is a thin-walled part in a disk shape and underside of the operating part is opened. A top side of operating part 17 is protruded in a rotatable manner from an upside of an opening part of package 16.

In FIG. 1 and FIG. 3 that is a partial cross-sectional view of the switching device, switch 12 is placed inside an inner periphery of operating part 17. A plurality of cams 18 are formed on an inner boundary of operating part 17 keeping a certain distance with each other, protruding inside so as to come into contact with lever 14, thus constituting switching device 19.

Pressing part 20 is composed of a sheet of rubber, elastomer or the like and is disposed on one of the main sides of wiring substrate 11. A plurality of keys 21, a thin-walled part in dome shape is disposed on a part of pressing part 20. Moving contact 22 which is made of carbon or the like is formed on an under plane of key 21. A plurality of fixed contacts 23 which is made of carbon or the like is formed on the main side of substrate 11, facing with moving contact 22 but keeping a certain distance from respective moving contact.

In FIG. 2, transmitter 24 which is composed of a light emitting diode and electronic components for transmitting a remote control signal, and controller 25 typically a microprocessor that is connected to terminal 15 and fixed contact 23 are mounted on the main side of substrate 11.

On pressing part 20, wall part 20A in substantially a rectangular tube shape is formed, standing upright and surrounding outer periphery of case 13 of switch 12, preventing switch 12 from being tilted or displaced, thus constituting remote control unit.

In above constitution, when operating part 17 of switching device 19 is rotated in a clockwise or in a counter clockwise direction, cam 18A or cam 18B protruded inward from the inner side of the boundary of operating part 17 comes into contact with lever 14 of switch 12 with the rotational movement of operating part 17, rocking lever 14 in R3 or L3 direction, making electrical connection and disconnection of the moving contact piece with the fixed contact piece, which are shown in FIG. 3.

When a rotational angle is large, for an example when operating part 17 is largely rotated in counter clockwise direction, lever 14 of switch 12 is first pushed by cam 18B and is rock-motioned toward L3 direction, then the lever once automatically returns to an original neutral position and then again pushed by cam 18C rock-motioned toward L3 direction, thus making two times of electrical connection and disconnection.

The electric signal caused by the electrical connection and disconnection is supplied to controller 25 through a plurality of terminals 15. As lever 14 is rock-motioned in either right or left direction namely in either R4 or L4 direction certain times, controller 25 detects the rotational direction and a rotational angle of operating part 17, recognizing a position of operating part 17 corresponding to the times of electrical connection and disconnection.

In response to the electrical connection and disconnection of switch 12 made by rotational movement of operating part 17, controller 25 sends out an infrared remote control signal from transmitter 24, thereby remotely controlling audio volume, channel selection of TV, temperature of air-conditioner, a cursor moving on a display, etc.

When a certain key 21 of the remote control unit is pressed, the key in substantially a dome shape is elastically deformed at its thin-wall portion, moving moving-contact 22 down to fixed contact 23 for connection. Thus, multiple times of connections of the moving contact with fixed contact 23 are made possible. Controller 25, in response to the electrical connections and disconnections of moving contact 22 with fixed contact 23, sends out a predetermined infrared remote control signal through transmitter 24.

Switch 12 is disposed inside the inner periphery of operating part 17 and lever 14 is engaged with a plurality of cams 18 formed at the inner boundary of operating part 17, constituting switching device 19. With this constitution, an extra space is made available around operating part 19 on wiring substrate 11, compared to a constitution in which switch 12 is disposed outside the outer periphery of operating part 17. Thus, wiring substrate 11 can be made smaller by the size of the extra space.

Moreover, in the exemplary embodiment of the present invention, employment of a high-density component insertion is made possible as some electronic components are disposed in the space around operating part 17. Accordingly, various functions can be added to switching device 19 and to a remote control unit, hence adding more function and realizing enriched feature.

As described, according to the exemplary embodiment, switch 12 is disposed inside the inner periphery of rotatable operating part 17 and lever 14 of switch 12 is engaged with cam 18 formed at the inner boundary of operating part 17, constituting the switching device. With this arrangement, miniaturization of the device is achieved and the switching device that can be produced with high density components mounting, and a remote control unit using the switching device are obtained.

Furthermore, wall part 20A is disposed standing upright on pressing part 20. By retaining switch 12 by wall part 20A, switch 12 is prevented from being tilted or being displaced, enabling a stable operation of the device.

Above, operating part 17 is explained as a rotationally moving part. However, operating part 17 can be a linearly moving part sliding in up and down direction or in right and left direction, so long as the cam formed at the inner side of operating part 17 comes into contact with switch 12 for detecting a linearly moving position of the operating part.

Moreover, for other exemplary embodiment, switch 12 and cams 18 can employ a variety of operating methods and physical shapes, so long as an electrical connection and disconnection of switch 12 can be repeated in response to rotational or other movement of operating part 17.

INDUSTRIAL APPLICABILITY

The switching device and the remote control unit using the switching device in accordance with the present invention can be miniaturized and produced using a high-density components mounting technology. The switching device and the remote control unit are particularly useful for operating a variety of electronic products. Therefore their industrial applicability is high.

The invention claimed is:

1. A switching device comprising:

(1) an operating part which is rotatable or movable;

(2) a cam which is formed at an inner boundary of the operating part; and (3) a switch disposed inside an inner periphery of the operating part with a lever of the switch being engaged with the cam, wherein, the lever is rock-motioned by a rotational operation or by a moving operation of the operating part, and wherein, an operated position of the operating part is detected by electrical connection and disconnection of the switch.

2. A remote control unit comprising:

(1) a switching device including;

an operating part which is rotatable or movable;

a cam which is formed at an inner boundary of the operating part; and a switch disposed inside an inner periphery of the operating part with a lever of the switch being engaged with the cam, in which the lever is rock-motioned by a rotational operation or by a moving operation of the operating part, in which an operated position of the operating part is detected with an electrical connection and a disconnection of the switch;

(2) a pressing part on which a plurality of keys is formed, a pressing operation of the key allowing a moving contact to make an electrical connection with and disconnection from a fixed contact; and (3) a controller connected to the switch and the fixed contact of the switching device, wherein the controller transmits a remote control signal through a transmitter corresponding to the electrical connection and disconnection of the switch and the electrical connection and disconnection of the moving contact with and from the fixed contact.

3. The remote control according to claim 2, wherein the pressing part includes a wall part protruding from the pressing part, the wall part retaining the switch.

* * * * *